US006612472B1

(12) United States Patent
Zakarin

(10) Patent No.: US 6,612,472 B1
(45) **Date of Patent: *Sep. 2, 2003**

(54) CARRYING BAGS AND STORAGE COMPARTMENTS FOR HEADWEAR

(75) Inventor: Lawrence J. Zakarin, Short Hills, NJ (US)

(73) Assignee: La Rue Distributors, Inc., New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 250 days.

(21) Appl. No.: 09/208,514

(22) Filed: Dec. 9, 1998

(51) Int. Cl.[7] ..... A45F 3/04

(52) U.S. Cl. ..... 224/652; 224/627; 224/645; 190/103; 190/111; 383/117

(58) Field of Search ..... 224/153, 582, 224/583, 674, 675, 677, 627, 645, 652, 653; 383/117; 190/109, 110, 103, 111

(56) References Cited

U.S. PATENT DOCUMENTS

| | | | | | |
|---|---|---|---|---|---|
| 1,711,349 | A | * | 4/1929 | Howard | 190/111 |
| 1,841,154 | A | * | 1/1932 | Rath | 190/111 X |
| D161,844 | S | | 2/1951 | Kreuter et al. | |
| 2,597,194 | A | * | 5/1952 | Sholl | 190/111 |
| 2,606,636 | A | * | 8/1952 | Braverman | 190/111 X |
| 2,837,185 | A | * | 6/1958 | Guenther | 190/111 |
| 3,233,803 | A | | 2/1966 | Gray | |
| D205,909 | S | | 10/1966 | Cline | |
| 3,321,120 | A | * | 5/1967 | Cunningham | 224/653 |
| 3,696,850 | A | * | 10/1972 | Rosenblum | 190/110 X |
| 4,059,207 | A | * | 11/1977 | Jackson et al. | 224/153 X |
| 4,085,873 | A | | 4/1978 | Schweitzer | |
| D249,594 | S | | 9/1978 | Stewart | |
| D250,226 | S | | 11/1978 | Shaw | |
| 4,236,615 | A | * | 12/1980 | Ginat | 190/111 |
| 4,424,841 | A | * | 1/1984 | Smith | 190/110 X |
| 4,580,667 | A | * | 4/1986 | Herwood | 383/117 X |
| 4,767,039 | A | | 8/1988 | Jacober | |
| 4,883,207 | A | | 11/1989 | McArthur | |
| 4,998,603 | A | * | 3/1991 | Nordstrom | 190/110 X |
| D316,177 | S | | 4/1991 | Strimpfel | |
| D318,174 | S | | 7/1991 | Hanson | |
| 5,209,384 | A | | 5/1993 | Anderson | |
| D336,409 | S | | 6/1993 | Kahl et al. | |

(List continued on next page.)

FOREIGN PATENT DOCUMENTS

| | | | | |
|---|---|---|---|---|
| CH | 154365 | * | 7/1932 | 224/153 |
| CH | 259005 | * | 12/1948 | 224/215 |
| DE | 2506780 | * | 2/1976 | 190/111 |
| DK | 57338 | * | 2/1940 | 224/209 |
| FR | 835030 | * | 12/1938 | 190/109 |
| FR | 1010467 | * | 6/1952 | 224/153 |
| FR | 2577771 | * | 8/1986 | 190/110 |
| GB | 39607 | * | 7/1896 | 190/111 |
| GB | 607133 | * | 8/1948 | 190/103 |

*Primary Examiner*—Stephen K. Cronin
(74) *Attorney, Agent, or Firm*—Mark P. Stone

(57) ABSTRACT

The present invention is directed to improved carrying bags and improved storage compartments for headwear. A carrying bag, and in particular a backpack, includes a rear compartment formed in part from an expandable material for receiving oversized items such as basketballs, soccer balls, footballs and the like. When the oversized objects are removed from the compartment, the expandable material automatically retracts into a position in which it is substantially planar with a rear surface of the carrying bag. In a further aspect of the invention, a detachable headwear storage compartment is provided for both storing and protecting headwear when it is not being worn by the user. The storage compartment is removably attachable to any supporting element, as for example a strap of a carrying bag or backpack, or a belt worn by the user.

11 Claims, 3 Drawing Sheets

U.S. PATENT DOCUMENTS

D339,225 S 9/1993 Zel
D340,134 S 10/1993 Pollack
5,255,834 A 10/1993 Bendersky
5,275,316 A 1/1994 Kish
D345,049 S 3/1994 Pollack
D348,151 S 6/1994 Acheson
5,370,287 A 12/1994 Cormier
5,407,111 A * 4/1995 Lanouette et al. ..... 224/677 X
D358,023 S 5/1995 Poire
D360,072 S 7/1995 Poire
5,431,265 A * 7/1995 Yoo ..... 190/111 X
5,445,303 A * 8/1995 Cawile, Jr. ..... 224/677 X
5,458,278 A 10/1995 LaConte
5,480,023 A * 1/1996 Puller ..... 190/103 X
D369,524 S 5/1996 Gunter, II et al.
5,544,792 A * 8/1996 Arnwine ..... 224/583 X
D373,472 S 9/1996 Eaton et al.
5,632,429 A 5/1997 Cantwell
5,634,576 A 6/1997 Arbel
5,743,447 A 4/1998 McDermott
D396,745 S 8/1998 Peterson
5,950,895 A * 9/1999 Zakarin ..... 224/653 X

* cited by examiner

CARRYING BAGS AND STORAGE COMPARTMENTS FOR HEADWEAR

BACKGROUND OF THE INVENTION

Known backpacks are exemplified by the following United States patents: U.S. Pat. Nos. 3,233,803; 4,085,873; 4,767,039; 4,883,207; 5,209,384; 5,255,834; 5,275,316; 5,370,287; 5,458,278; 5,634,576; 5,632,429; 5,743,447; and U.S. Des. Pat. Nos. 249,594; 250,226; 316,177; 336,409; 339,225; 340,134; 345,049; 348,151; 358,023; 360,072; 396,745. U.S. Des. Pat. No. 373,472 discloses a carrier for a stored ball. U.S. Des. Pat. No. 369,524 discloses a cooler having a top with a baseball hat configuration thereon. Pending U.S. patent application Ser. No. 08/992,013, filed Dec. 17, 1997, and pending U.S. Des. patent application Ser. No. 29/090,281, filed Jul. 6, 1998, both of which were invented by the present Applicant, disclose carrying bags, and in particular backpacks, including a storage compartment adapted to store and protect headwear received therein.

It is a primary object of the present invention to provide an improved carrying bag and in particular a backpack, which is adapted to receive and store oversized objects, and in particular sports balls including basketballs, soccer balls and footballs.

It is a further object of the present invention to provide an improved storage compartment for headwear. Hat storage devices are exemplified by U.S. Des. Pat. No. 161,844, U.S. Des. Pat. No. 205,909 and U.S. Des. Pat. No. 318,174. These known storage devices for headwear do not provide means for removable attachment to a supporting element, as for example, the strap of a carrying bag or a backpack, or the belt of a wearer. It is therefore another primary object of the present invention to provide a headwear storage device including means for removably attaching the device to a supporting element worn or carried by the user.

Other objects and advantages of the improvements of the present invention will become apparent to those skilled in the art from the following discussion.

SUMMARY OF THE INVENTION

In accordance with the present invention, a carrying bag, and in particular a backpack, includes at least one compartment formed, at least in part, from an expandable material. An oversized object, as for example, a basketball, soccer ball or football, is received within the compartment which expands to accommodate the oversized article. The compartment can include closure means, as for example a zipper, to securely retain the oversized article in the storage compartment. When the article is removed from the compartment, the expandable material automatically retracts into a non-extended position in which the storage compartment is oriented substantially planar to the surface of the carrying bag from which it extends. Preferably, the expandable storage compartment is defined on the rear surface of the carrying bag or backpack, and expands in a rearward direction so that the oversized article stored in the extended storage compartment is oriented away from the body of a wearer when the backpack is being worn.

In a further aspect of the invention, a storage device for headwear includes means for removably attaching the device to a supporting element, as for example a strap of a carrying bag or backpack, a belt worn by a wearer, or belt loops on the clothing of a wearer. In this manner, the storage device for headwear can be carried by a user attached to a backpack on occasions when the user is wearing or carrying the backpack, or can be attached to a different supporting element (such as a belt or other article of clothing) on occasions when the user is not carrying the backpack.

DISCUSSION OF THE BEST MODES FOR CARRYING OUT THE INVENTION

Figure 1:
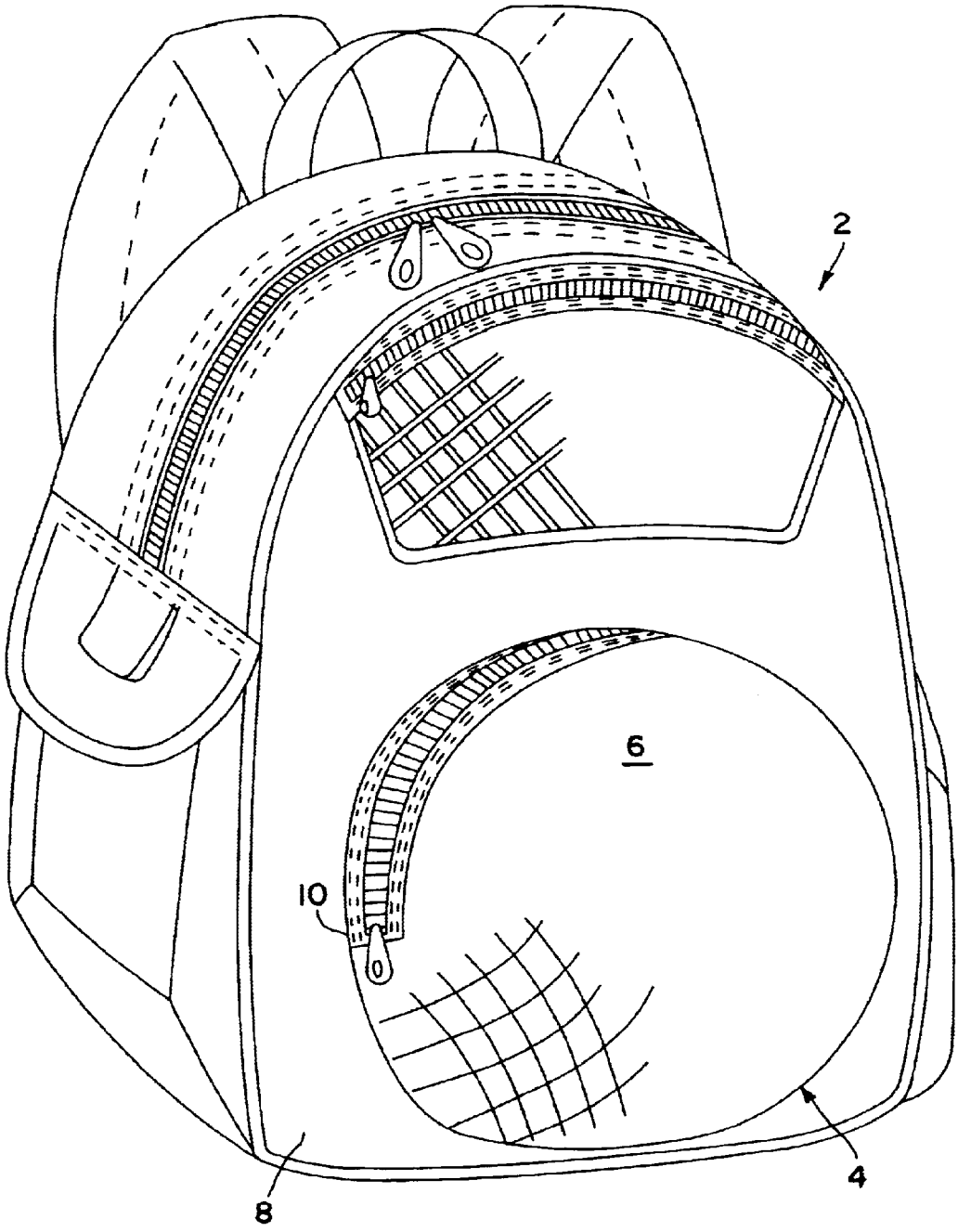
FIG. 1 illustrates a perspective view of a backpack in accordance with the present invention.
Figure 3:
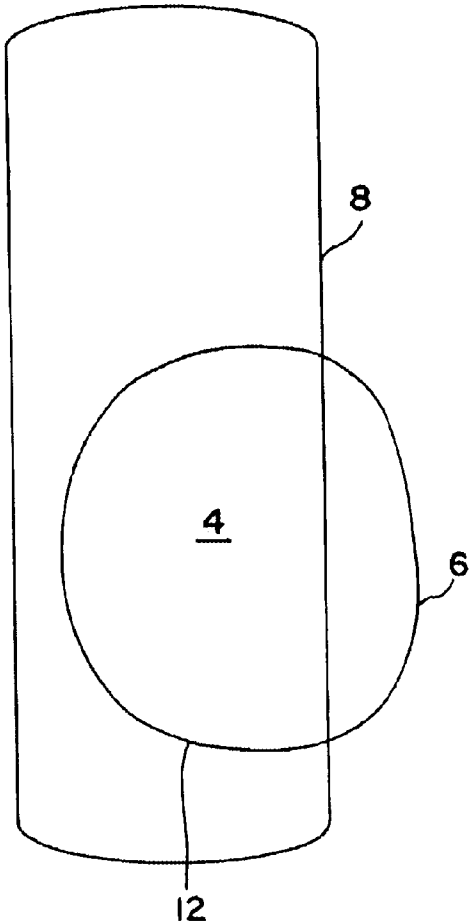
FIG. 3 illustrates a sectional side elevational view of the backpack when the storage compartment is in an expanded position to accommodate an oversized article.
Figure 2:
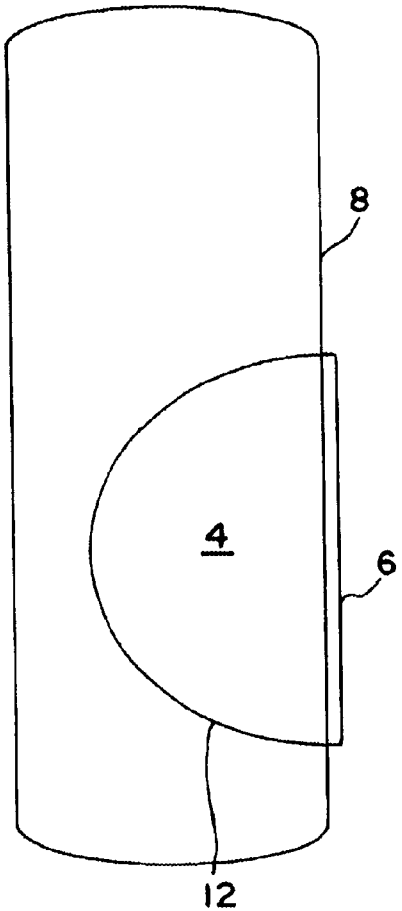
FIG. 2 illustrates a sectional side elevational view of the backpack of FIG. 1 when no article is stored in a storage compartment of the backpack.

FIGS. 1–3 of the drawing illustrate an improved carrying bag, and in particular a backpack, in accordance with the present invention. The backpack is generally designated by the reference numeral 2 and includes an expandable storage compartment designated by the reference numeral 4. A front surface 6 of the storage compartment is formed from an expandable material, such as nylon stretch mesh, which will be stretched into an extended configuration as a result of an external force applied to it, but will return to a normal retracted position when the force is released. The storage compartment 4 is defined on a portion of a rear surface 8 of the backpack. Closure means, as for example, a zipper 10, are provided to selectively open and close the top of the storage compartment 4 to permit an article to be received in or removed from the storage compartment.

FIG. 2 schematically illustrates the backpack of FIG. 1 when no article is received in the storage compartment 4, and FIG. 3 schematically illustrates the backpack when an article is received in the storage compartment. The storage compartment 4 is adapted to accommodate oversized articles such as basketballs, soccer balls, or footballs. In operation, the zipper 10 is opened and an article such as a basketball, is placed into the storage compartment 4 and is received in an internal pocket defined by an inner lining 12 of the storage compartment. However, a portion of the oversized article in the storage compartment 4 extends rearwardly beyond the rear surface 8 of the backpack and causes the surface 6 of the storage compartment to expand rearwardly and extend beyond the rear surface of the storage compartment. The storage compartment is closed by the zipper 10 to securely retain the article therein, as schematically illustrated by FIG. 3.

The reverse procedure is followed to remove the article from the compartment 4. The zipper is opened, the article is removed from the storage compartment, and the expandable material forming the surface 6 of the storage compartment automatically contracts into its retracted position shown by FIG. 2 in which the front surface 6 of the storage compartment is substantially planar with the rear surface 8 of the backpack. The retraction occurs automatically since the outwardly directed force applied to the expandable surface 6 by the oversized article received in the compartment 4 is released after the article has been removed from the compartment. In this manner, the expandable surface 6 of the storage compartment 4 will remain taut after the article has been removed from the compartment, and thus will not hang downwardly from the rear surface of the backpack. This eliminates the need to provide securing means, as for example, straps or buckles to prevent the rear surface 6 from dragging when no article is being stored in the compartment 4.

Figure 5:
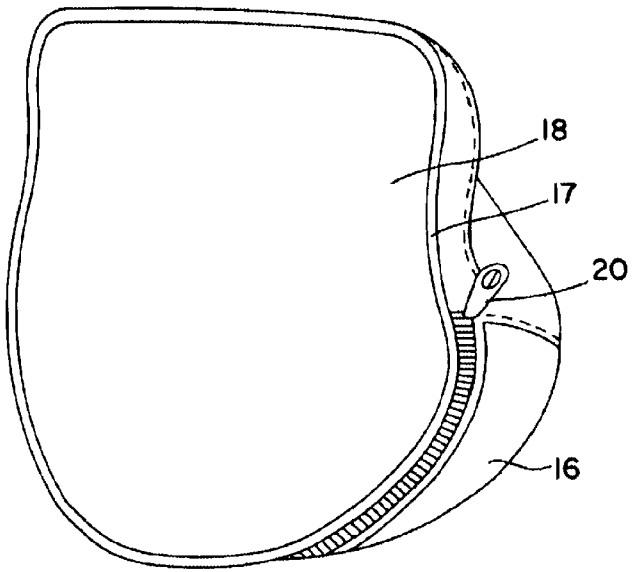
FIG. 5 is a rear view of a portion of the headwear storage device illustrated by FIG. 4.
Figure 4:
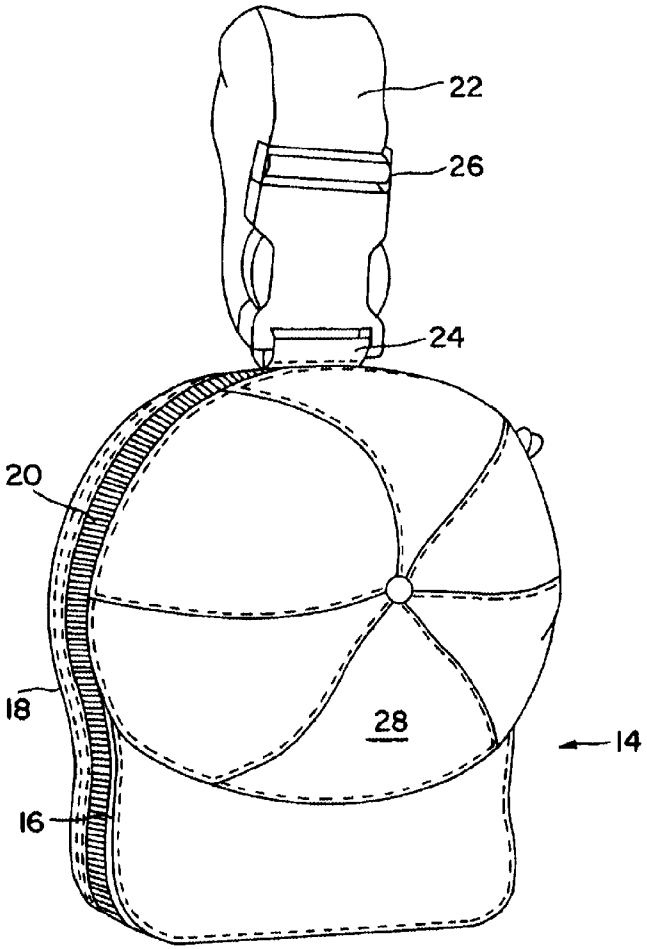
FIG. 4 is a perspective view of a removably attachable headwear storage device in accordance with a further aspect of the present invention.

FIGS. 4–5 illustrate a headwear storage compartment generally designate by reference numeral 14. The storage compartment generally simulates the shape of headwear to be received therein, which in the case of FIGS. 4–5 is a baseball cap. The storage compartment 14 is formed from a front first section 16 joined to a rear second section 18 along adjacent portions thereof such as that illustrated by reference numeral 17. Closure means, illustrated by a zipper 20, permits a user to selectively open and close the compartment 14 for receiving and removing headwear. A loop shaped strap designated by reference numeral 22 is attached to the top portion of the front section 16 of the compartment 14 by an attachment element designated by reference numeral 24. In the alternative, a portion of the strap can be stitched to one of the sections 16 or 18. A closure element for the strap, such as a buckle designated by reference numeral 26, is provided to permit the strap to be opened and closed.

In operation, the strap 22 is attached to a supporting element, as for example, a strap of a backpack, such as that illustrated by FIG. 1 of the drawing, or to a belt or belt loop or other article of clothing worn by the user. In this manner, the headwear storage compartment 14 is removably attachable to different supporting elements at the selection of the user.

The strap 22 can be replaced by other known connecting elements, such as chains or ropes. Similarly, closure elements other than the buckle 26, such as hooks, clasps, hooks and links, clasps and links, snaps, or buttons can be employed. Additionally, the connecting strap 22 can be eliminated, and the compartment 14 can be removably attached to a supporting element by an attachment element (a clasp or hook) attached directly to one of the sections 16 or 18 of the compartment. The attachment element 24 connecting the storage compartment 14 to the strap 22 can be eliminated, and the strap can be threaded through an opening provided in section 16 of the compartment 14. It is also within the scope of the present invention to provide strap 22 as a permanently closed loop attached to one of the sections 16 and 18, with a locking element (a hook, a clasp, a snap) mounted to a portion of the closed loop for removably attaching the storage compartment 14 to a supporting element. Accordingly, the scope of the subject invention is not limited to any specific means for connecting the storage compartment to a supporting element, nor is it limited to any specific closure means for removably attaching the storage compartment to a supporting element.

In a further aspect of the invention, portion 28 of the front section 15 of the storage compartment 14 can be formed from a transparent material. In this manner, a corresponding portion of the headwear stored in compartment 14, as for example a team logo on a baseball cap, will be visible through the storage compartment 14.

Other advantages and modifications of the invention disclosed herein will become apparent to those skilled in the art. Accordingly, the discussion of the preferred embodiments of the improved carrying bag and the improved headwear storage compartment discussed herein are intended to be illustrative, and not restrictive, of the scope of the invention, that scope being defined by the following claims in all equivalents thereto.

What is claimed is:

1. A carrying bag including:

at least one storage compartment, said at least one storage compartment being formed from a recess defined in a first surface of said carrying bag, a material covering said recess, and access means operatively associated with said material to permit an article to be received in said recess and retained in said recess by said material, said material being expandable into an expanded configuration to accommodate a portion of said article received in said recess and extending beyond said first surface of said carrying bag, said material being automatically retractable into a retracted configuration substantially planar with said first surface of said carrying bag when said article is removed from said recess.

2. The carrying bag as claimed in claim 1 wherein said material covering said recess is formed, at least in part, from a nylon stretch mesh.

3. The carrying bag as claimed in claim 1 including closure means operatively associated with said access means for selectively closing said at least one storage compartment.

4. The carrying bag as claimed in claim 1 wherein said first surface defines a rear surface of said carrying bag.

5. The carrying bag as claimed in claim 4 wherein said recess is substantially concave in configuration.

6. The carrying bag as claimed in claim 5 wherein said material covering said recess is formed, at least in part, from a nylon stretch mesh.

7. The carrying bag as claimed in claim 1 wherein said carrying bag is a backpack.

8. The carrying bag as claimed in claim 7 including closure means for selectively closing said at least one storage compartment.

9. The carrying bag as claimed in claim 7 wherein said first surface comprises a rear surface of said backpack, and said at least one storage compartment is defined on said rear surface of said backpack such that said material covering said recess is oriented to expand in a direction outwardly from said rear surface of said backpack.

10. The carrying bag as claimed in claim 9 wherein said material covering said recess is formed, at least in part, from a nylon stretch mesh.

11. A carrying bag including:

at least one storage compartment;

said at least one storage compartment being formed from a recess defined in a first surface of said carrying bag, a material covering said recess, and access means operatively associated with said material to permit an article to be received in said recess and retained in said recess by said material, said material being expandable into an expanded configuration to accommodate a portion of said article received in said recess and extending beyond said first surface of said carrying bag, said material being automatically retractable into a retracted configuration substantially planar with said first surface of said carrying bag when said article is removed from said recess; and a compartment for storing headwear, and means for removably attaching said compartment to a portion of said carrying bag.

* * * * *